US005239728A

United States Patent [19]

Redman

[11] Patent Number: 5,239,728

[45] Date of Patent: Aug. 31, 1993

[54] INTERLOCKING ADJUSTABLE CENTER PIVOT

[75] Inventor: Ronald E. Redman, Tucker, Ga.

[73] Assignee: Kawneer Company, Inc., Norcross, Ga.

[21] Appl. No.: 902,984

[22] Filed: Jun. 23, 1992

[51] Int. Cl.[5] ..... E05D 7/04

[52] U.S. Cl. ..... 16/244; 16/97; 160/206

[58] Field of Search ..... 16/97, 244; 160/206

[56] References Cited

U.S. PATENT DOCUMENTS

| | | | |
|---|---|---|---|
| 3,662,493 | 5/1972 | Foltz | 16/244 |
| 3,805,324 | 4/1974 | Johnson | 16/244 |
| 3,895,412 | 7/1975 | Johnson | 16/244 |

OTHER PUBLICATIONS

Kawneer Architectural Products, "Instructions for Replacement of Bottom Center Pivot," Kawneer Company, Inc., Norcross, Ga. (Mar. 1978).

Dorma Door Controls, Inc., "Dorma RTS 85 Overhead Concealed Door Closers," Reamstown, Pa. (1986).

*Primary Examiner*—W. Donald Bray

*Attorney, Agent, or Firm*—Jones & Askew

[57] ABSTRACT

An improved adjustable center door pivot assembly is disclosed which can be mounted to a threshold without the need for a separate mounting bracket. The adjustable center pivot assembly permits the height of the pivot spindle to be adjusted without removing the door. Further, the height of the adjustable center pivot assembly which projects above the threshold is sufficiently short that the pivot assembly can be used with a standard door having a standard 21/32" web.

6 Claims, 4 Drawing Sheets

Fig. 1B
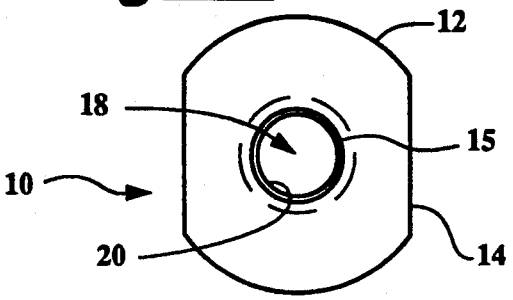
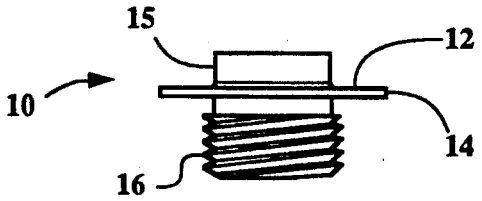
Fig. 1A
Fig. 2B
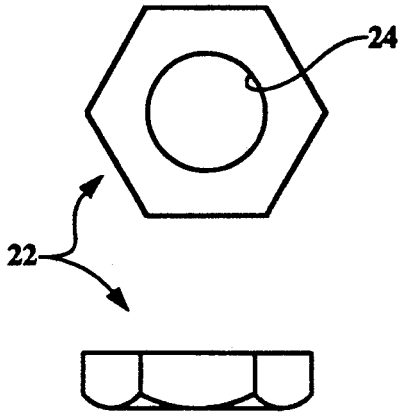
Fig. 2A
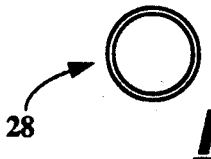
Fig. 3B
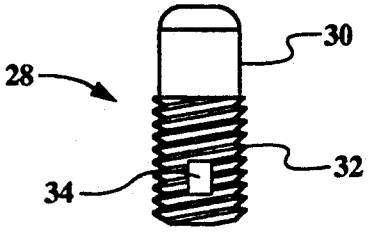
Fig. 3A
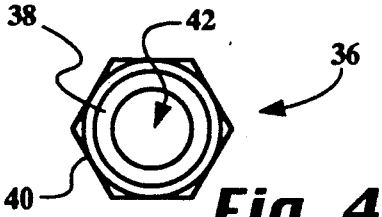
Fig. 4B
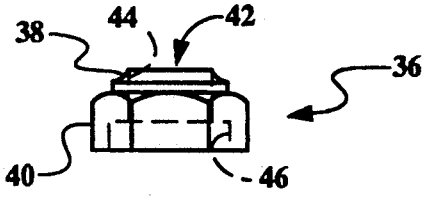
Fig. 4A

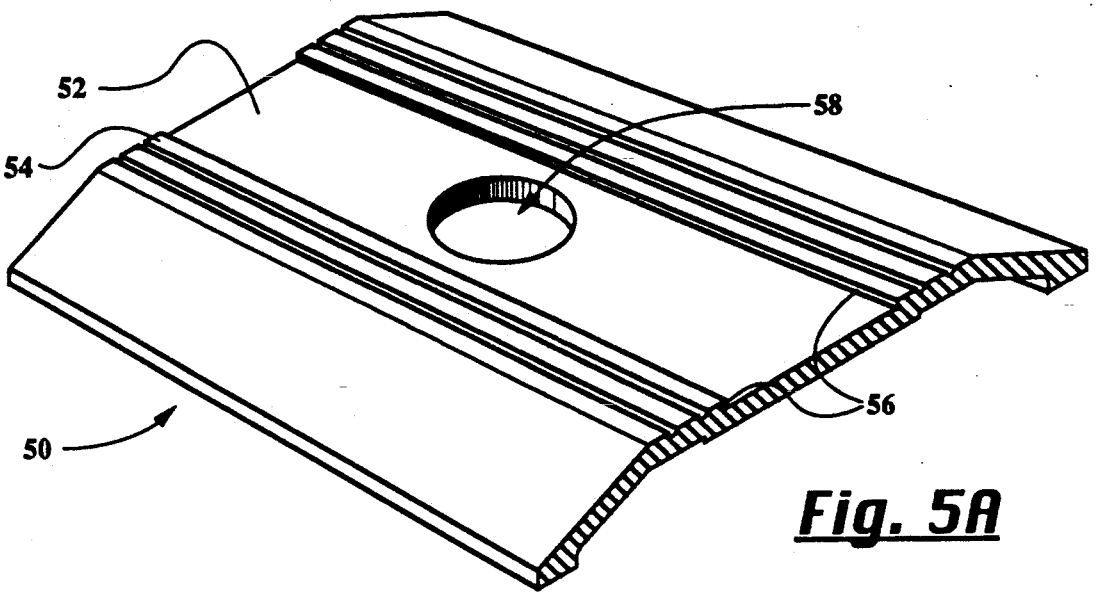
Fig. 5A
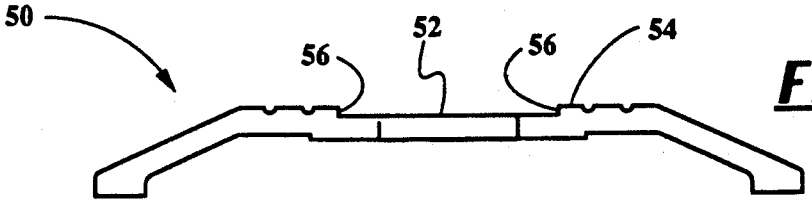
Fig. 5B
Fig. 7B
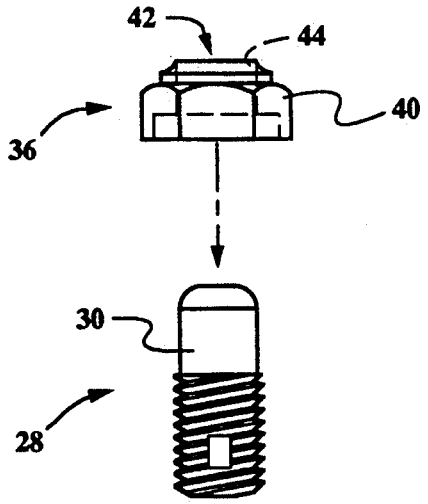
Fig. 6
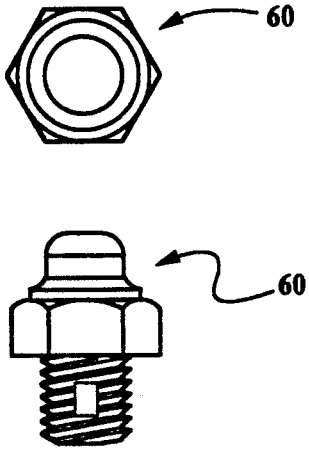
Fig. 7A

INTERLOCKING ADJUSTABLE CENTER PIVOT

TECHNICAL FIELD

The present invention relates generally to pivots for pivotably mounting doors, windows, and the like. More specifically, the present invention relates to a center pivot mounted directly to the threshold of a door.

BACKGROUND OF THE INVENTION

When it is desired to mount a door or window to pivot both inward and outward, a "center pivot" is commonly used. Center pivots are so called because they are mounted on the horizontal center line of the door midway between and parallel to the inner and outer door surfaces. The most common arrangement for mounting a bottom center pivot is to mount the pivot to an L-shaped bracket, the upright leg of which is fastened to the door frame and the horizontal leg of which rests on the floor. The spindle of the pivot extends upward from the horizontal leg of the L-shaped bracket, and the door is installed on the pivot spindle. In applications which employ a threshold, it is necessary to drill or notch the threshold so that it will clear the pivot spindle.

This type of mounting arrangement, though widely used, suffers certain disadvantages when used in conjunction with a threshold. First, two separate members—the mounting bracket and the threshold—must be installed. Installation is further complicated by the requirement that the L-shaped mounting bracket and the threshold be properly aligned to permit the pivot spindle to clear the cutout in the threshold. Accordingly, there is a need for an improved mounting arrangement for a bottom center pivot when used in conjunction with a threshold.

One approach to this problem has been to mount a bottom center door pivot directly to the threshold. This type of center door pivot is sold by Dorma Door Controls, Inc. and others. This type of pivot assembly comprises a threshold lug which includes a hexagonal head portion and a downwardly extending tubular shaft which is threaded on its interior and exterior surfaces. The shaft of the threshold lug is inserted through a hole in the threshold, and a nut is threaded onto the outer threaded shaft surface from the opposite side of the threshold to clamp the threshold lug in place. A pivot spindle is then threaded into the threshold lug by means of a screw slot formed in the top of the pivot spindle. A lock nut is then threaded over the pivot spindle and tightened against the head of the threshold lug to prevent the pivot assembly from turning. The door with its associated bearings is then installed onto the pivot spindle.

While this approach eliminates the need for a separate mounting bracket, this type of mounting arrangement suffers its own disadvantages. Because of the requirement that the head portion of the threshold lug and the lock nut both sit atop the threshold and the spindle project above both of these elements, this type of adjustable threshold pivot set extends a considerable distance above the upper surface of the threshold. Consequently, a door with a standard 21/32" inch web cannot be used with this type of pivot arrangement. Rather, a door with a 1-9/16" deep web must be used. Further, since the tool engaging portion of the pivot spindle is a screw slot in the top of the spindle, the door must be removed from the spindle to access the screw slot to adjust the height of the pivot.

Thus, there is a need for an adjustable center pivot which can be mounted directly to a threshold and can accommodate a standard 21/32" web.

There is a further need for an adjustable center pivot which can be mounted directed to the threshold and which permits height adjustment without having to remove the door from the pivot.

SUMMARY OF THE INVENTION

As will be seen, the present invention overcomes these and other problems associated with prior art adjustable center door pivots. Stated generally, the present invention comprises an improved adjustable center door pivot assembly which can be mounted to a threshold without the need for a separate mounting bracket. The adjustable center pivot assembly permits the height of the pivot spindle to be adjusted without removing the door. Further, the portion of the adjustable center pivot assembly which projects above the threshold is sufficiently short that the pivot assembly can be used with a standard door having a standard 21/32" web.

Stated somewhat more specifically, the present invention comprises an adjustable center door pivot assembly for mounting to a threshold. The door pivot assembly comprises a threshold lug having a collar, a shank extending above the collar, and an exteriorly threaded shaft extending below the collar. A threaded bore is formed through the threshold lug. A threshold lug nut screws onto the exteriorly threaded shaft of the threshold lug. To mount the threshold lug to a threshold, the shaft of the threshold lug is inserted through a hole in the threshold from above until the collar of the threshold lug bears against the threshold. The threshold lug nut is then threaded onto the exteriorly threaded shaft of the threshold lug from the lower side of the threshold to clamp the threshold lug to the threshold.

The door pivot assembly further comprises a pivot pin having an upper stem and a threaded lower shaft configured to threadingly engage the threaded bore of the threshold lug. A cap member is fixedly mounted onto the upper stem of the pivot pin and has a tool engaging upper portion. The tool engaging portion of the cap member may be engaged by a suitable tool such as a wrench to thread the pivot pin into the threaded bore of the threshold lug. A recess dimensioned to clear the shank of the threshold lug is formed in the lower surface of the cap member such that when the pivot pin is threaded into the threaded bore of the threshold lug, the cap member fits down over the shank to reduce the height of the door pivot assembly which extends above the threshold. In this manner, the height of door pivot assembly can be minimized to accommodate a standard door with a standard 21/32" web.

Thus it is an object of the present invention to provide an improved adjustable center door pivot.

It is another object of the present invention to provide an adjustable center door pivot which can be mounted to a threshold without the need for a separate mounting bracket.

A further object of the present invention is to provide an adjustable center door pivot for mounting to a threshold which permits height adjustment of the pivot without removing the door mounted thereto.

Still another object of the present invention is to provide an adjustable center door pivot which will mount to a threshold and still accommodate a standard door having a standard 21/32" web.

Other objects, features, and advantages of the present invention will become apparent upon reading the following specification, when taken in conjunction with the drawings and the appended claims.

BRIEF DESCRIPTION OF THE DRAWINGS

FIG. 1A is side view of a center pivot threshold lug of an interlocking adjustable center pivot assembly according to the present invention; FIG. 1B is a top view of the center pivot threshold lug of FIG. 1A.

FIG. 2A is a side view of a center pivot threshold lug nut of the pivot assembly of an interlocking adjustable center pivot assembly according to the present invention; FIG. 2B is a top view of the center pivot threshold lug nut of FIG. 2A.

FIG. 3A is a side view of a center pivot pin of an interlocking adjustable center pivot assembly according to the present invention; FIG. 3B is a top view of the center pivot pin of FIG. 3A.

FIG. 4A is a side view of a center pivot pin cap of an interlocking adjustable center pivot assembly according to the present invention; FIG. 4B is a top view of the center pivot pin cap of FIG. 4A.

FIG. 5A is a perspective view of a threshold of an interlocking adjustable center pivot assembly according to the present invention; FIG. 5B is a side view of the threshold of FIG. 5A.

FIG. 6 is a side view showing the center pivot pin cap of FIGS. 4A and 4B being assembled onto the center pivot pin of FIGS. 3A and 3B.

FIG. 7A is a side view of a center pivot pin assembly comprising the center pivot pin of FIGS. 3A and 3B and the center pivot pin cap of FIGS. 4A and 4B; FIG. 7B is a top view of the center pivot pin assembly of FIG. 7A.

DETAILED DESCRIPTION OF THE DISCLOSED EMBODIMENT

Figure 8:
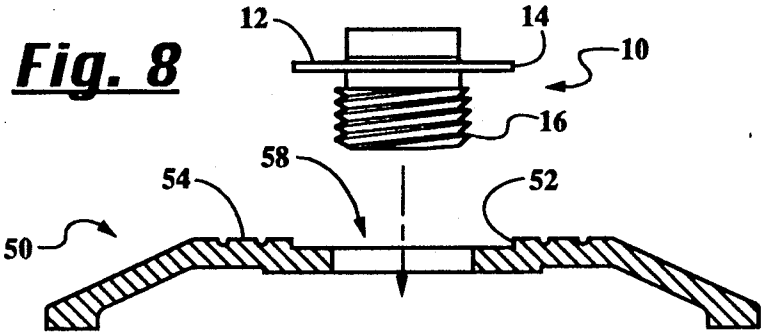
FIG. 8 is a cutaway view showing the assembly of the threshold lug of FIGS. 1A and 1B onto the threshold of FIGS. 5A and 5B.

Referring now in detail to the drawings, in which like numerals indicate like elements throughout the several views, FIGS. 1A and 1B show a threshold lug 10 of an interlocking adjustable center pivot assembly according to the present invention. The threshold lug 10 comprises a collar 12 having an essentially disc-shaped, annular configuration. The collar is truncated on opposed sides to form a pair of parallel straight walls 14. A smooth shank 15 extends upwardly from the collar 12, and an externally threaded shaft 16 extends downwardly from the collar. A coaxial bore 18 extends through the center pivot threshold lug 10 and has threaded interior walls 20.

Referring now to FIGS. 2A and 2B, a center pivot threshold lug nut 22 comprises a hexagonal nut having a threaded bore 24 configured to be threaded onto the threaded shaft 16 of the center pivot threshold lug 10. The function and purpose of the center pivot threshold lug nut 22 will become apparent when the assembly of the adjustable center pivot assembly is explained hereinbelow.

FIGS. 3A and 3B show a center pivot pin 28. The center pivot pin 28 has a smooth upper stem 30 and a threaded lower shaft 32. Optionally, a small nylon patch 34 may be installed in the lower threaded shaft 32 to enhance the tightness of a threading engagement to meet 40 to 60 inch pounds of torque for installation.

FIGS. 4A and 4B show a center pivot pin cap 36. The upper portion of the pivot pin cap 36 has a concave radius wall 38 for supporting a bearing. The lower portion of the pivot pin cap 18 comprises a hexagonal nut portion 40 which can be engaged by a suitable tool, such as a wrench, for turning the pivot pin cap. A smooth bore 42 is formed coaxial with the vertical axis of the pivot pin cap 18. An upper portion of the bore 42 comprises an interference portion 44. A coaxial annular recess 46 is formed in the lower face of the pivot pin cap 36 and is of a dimension slightly larger than the shank 15 of the threshold lug 10.

FIGS. 5A and 5B depict a section of a threshold 50. The threshold 50 is of generally convex shape and comprises a recessed portion 52 running the length of its upper surface 54. The recess 52 defines opposed vertical walls 56. A vertical bore 58 is formed on the longitudinal axis of the threshold 50 at a location 2¾" from one end.

Assembly and installation of an adjustable center pivot assembly will now be explained with reference to FIGS. 6 through 11. Referring first to FIGS. 6, 7A, and 7B, the pivot pin cap 36 is press fit onto the smooth upper stem 30 of the pivot pin 28. The interference portion 44 of the smooth bore 42 of the pivot pin cap 36 snugly engages the smooth upper stem portion 30 of the pivot pin 28 to form a center pivot pin assembly 60. The interference fit between the center pivot pin cap 36 and the center pivot pin 28 is sufficiently tight that the pivot pin and pivot pin cap are effectively locked together. Accordingly, torque transmitted by a wrench against the hexagonal nut portion 40 of the pivot pin cap 36 will be transmitted to the pivot pin 28 and cause the entire center pivot pin assembly 60 to rotate. It will be appreciated that the assembly of the pivot pin cap 36 onto the pivot pin 28 can be accomplished at the factory prior to being shipped to the job site.

Figure 9:
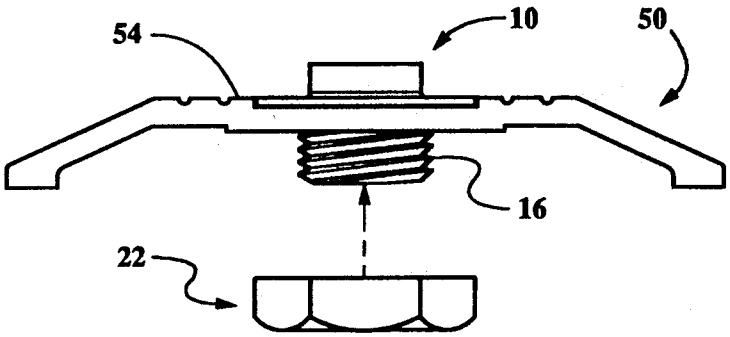
FIG. 9 is a side view of the assembled threshold lug and threshold of FIG. 8 and showing the assembly of the threshold lug nut of FIGS. 2A and 2B onto the threshold lug.

The threshold lug 10 and threshold lug nut 22 are now installed onto the threshold 50. As shown in FIG. 8, the threaded shaft 16 of the threshold lug 10 is first inserted downward through the bore 58 in the threshold 50. The threshold lug 10 is rotatably adjusted until the collar 12 fits down into the recess 52 in the upper surface 54 of the threshold 50. The flat walls 14 of the collar 12 engage the side walls 56 of the recess 52 and prevent rotational movement of the threshold lug 10 with respect to the threshold 50. The threshold lug nut 22 is then threaded onto the threaded shaft 16 of the threshold lug 10 from beneath the threshold 50, as shown in FIG. 9, clamping the threshold lug securely to the upper surface 54 of the threshold.

Figure 10:
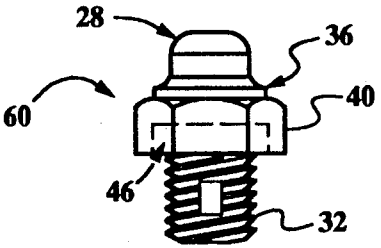
FIG. 10 is a side view of the assembled threshold, threshold lug, and threshold lug nut of FIG. 9 showing the assembly of the center pivot pin assembly of FIG. 7 onto the threshold lug.
Figure 11:
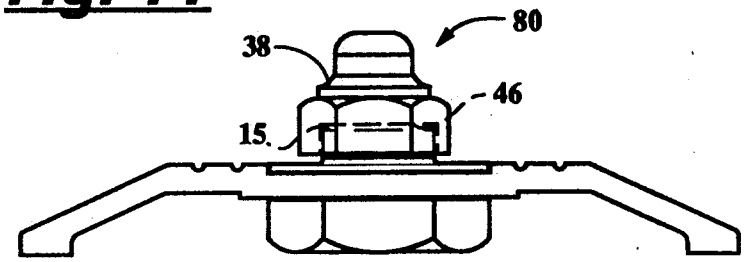
FIG. 11 is a side view of a center pivot pin assembly comprising the threshold, threshold lug, threshold lug nut, and pivot pin assembly of FIG. 10 assembled according to the present invention.

The center pivot pin assembly 60 is then threaded into the upper end of the threshold lug 10 as shown in FIG. 10, using a wrench on the hexagonal tool engaging portion 40 of the pivot pin cap 36. The threaded lower shaft 32 of the pivot pin 28 threads into the threaded bore 18 of the center pivot threshold lug 10 to form an interlocking center pivot assembly 80, shown in FIG. 11. As the center pivot pin assembly 60 is threaded into the threshold lug 10, the annular recess 46 in the lower face of the pivot pin cap 36 clears the smooth upper shank portion 15 of the threshold lug 10 in the manner shown in FIG. 11, and the pivot pin cap 36 thereby fits down over the shank 15 of the threshold lug 10. The height of the pivot assembly 80 above the upper surface 54 of the threshold 50 is determined by the extent to which the center pivot pin assembly 60 is threaded into the threshold lug 10.

Figure 12:
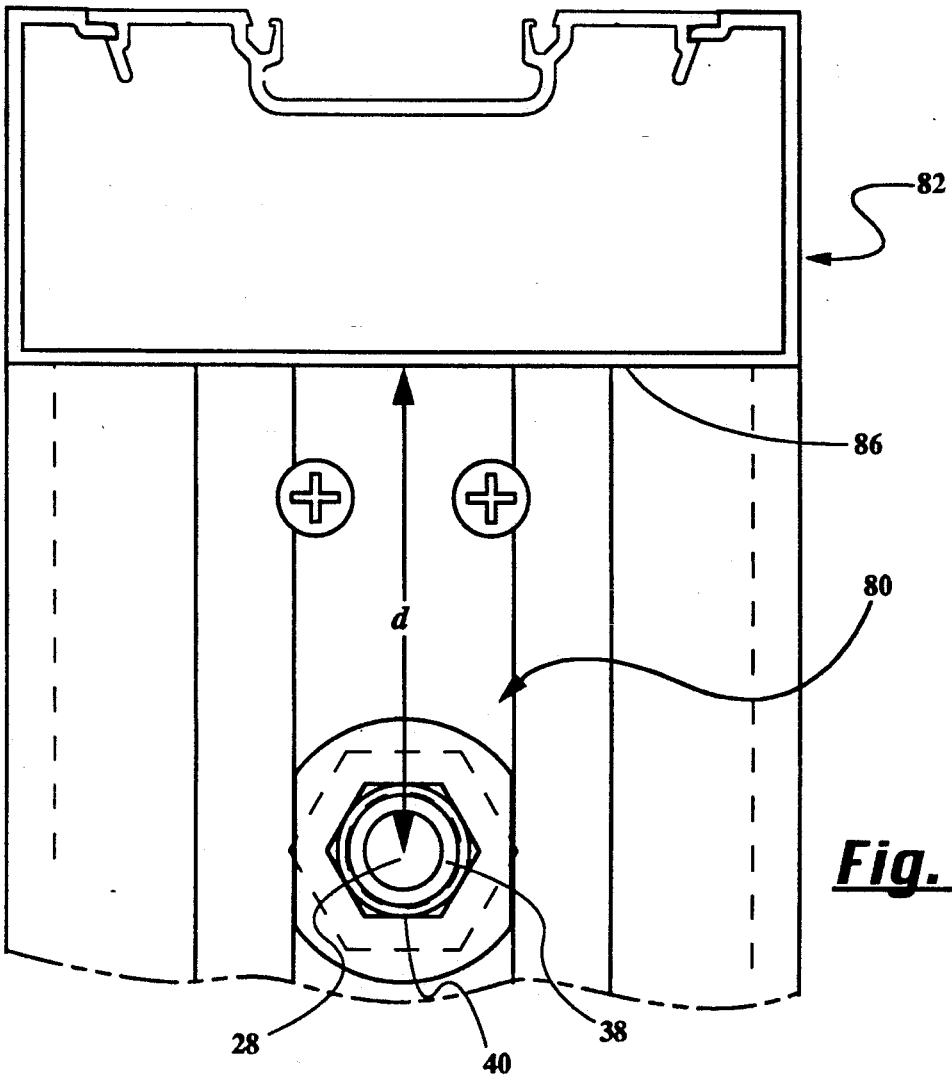
FIG. 12 is a is a top view of the center pivot pin assembly of FIG. 11.
Figure 13:
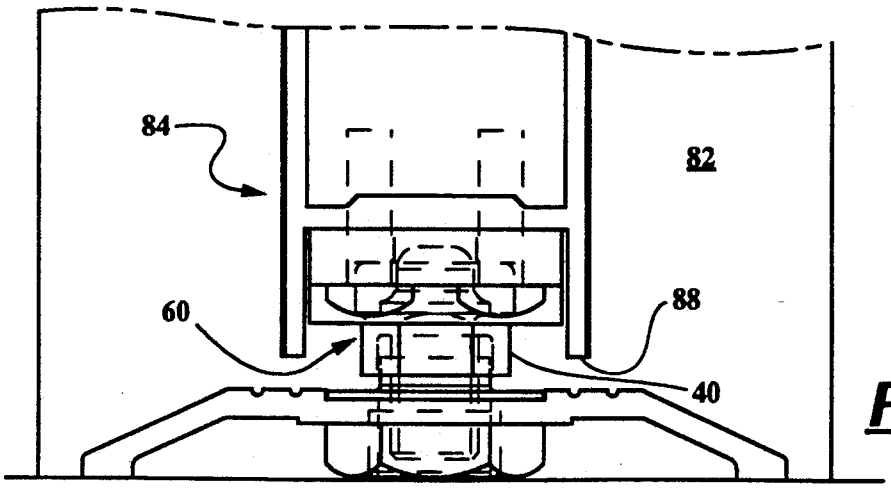
FIG. 13 is a side view of the center pivot pin assembly of FIG. 11 with a door mounted thereto, the door being partially cut away to reveal interior detail.

FIGS. 12 and 13 depict the interlocking center pivot assembly 80 installed in a door frame 82 with a door 84 mounted thereto. With reference to FIG. 12, the axis of the pivot pin 28 is offset from the pivot jamb 86 by a distance d of 2¾", as dictated by industry standards. In FIG. 13, the door 84 is supported on the pivot assembly 80 by means of a bearing secured to the door 84 which fits over the exposed upper end of the pivot pin 28 and is supported by the concave annular wall 38 of the pivot pin cap 36.

As can be seen in FIG. 13, the tool engaging portion 40 of the pivot pin assembly 60 is located below the lower edge 88 of the door 84 when the door is installed on the pivot assembly 80. The advantage of this feature is that a 7rench can be inserted beneath the lower edge 88 of the door 84 to engage the tool engaging portion 40 of the pivot pin cap 36 to adjust the height of the pivot pin assembly 60 without having to remove the door.

Another feature of the disclosed embodiment is the provision of a recess 46 in the bottom face of the pivot pin cap 36 which clears the upwardly projecting shank 15 of the threshold lug 10, thereby permitting the pivot pin assembly 60 to be advanced downward over the shank. Since the shank 15 of the threshold lug 10 is recessed within the pivot pin cap 36, rather than the pivot pin cap having to sit atop the shank, the overall height of the pivot assembly 80 above the upper surface 54 of the threshold 50 can be reduced. Consequently, the adjustable door pivot assembly 80 of the present invention can be used with a door having a standard 21/32" web.

The adjustable pivot assembly 80 of the preferred embodiment has been disclosed with respect to a pivot pin 28 having a cylindrical stem 30 and a pivot pin cap 36 having a smooth bore 42. While close attention to manufacturing tolerances will provide a sufficiently tight interference fit between the pivot pin cap 36 and the pivot pin 28 to prevent the pivot pin cap from rotating on the pivot pin when torque is applied to the tool engaging portion 40 of the pivot pin cap 36, it will be appreciated that other configurations of pivot pins and pivot pin caps may provide even greater resistance to relative rotation between these two components. For example, a pivot pin can be provided with a shank which is polygonal in cross-section, and a pivot pin cap can be provided with a corresponding polygonal opening. In such an embodiment, engagement of the respective polygonal walls will prevent the pivot pin cap from turning on the pivot pin. Alternatively, the shank of the pivot pin and the pivot pin cap can each be provided with corresponding key openings which are aligned when the pivot pin cap is press fit onto the pivot pin. A key can then be inserted into the recess defined by the corresponding key openings to prevent the pivot pin cap from turning on the pivot pin.

The pivot assembly 80 of the present invention has also been disclosed with respect to a threshold lug 10 having a collar 12 which is received within a corresponding recess 52 in the upper surface 54 of the threshold 50 to prevent relative rotation of the threshold lug with respect to the threshold. However, it will be appreciated that the pivot assembly of the present invention can also be used with a threshold which does not have such a recess. In such an instance, it may be desirable to provide the upper portion of the threshold lug with some form of tool-engaging surface by which the threshold lug can be restrained from turning while the threshold lug nut is tightened.

Finally, it will be understood that the preferred embodiment has been disclosed by way of example, and that other modifications may occur to those skilled in the art without departing from the scope and spirit of the appended claims.

What is claimed is:

1. An adjustable door pivot assembly for mounting to a threshold having a hole formed therethrough, said door pivot assembly comprising:

a threshold lug having a collar, a shank extending above said collar, and an externally threaded shaft extending below said collar, said threshold lug having a threaded bore formed therethrough;

a threshold lug nut for threadingly engaging said externally threaded shaft of said threshold lug;

a pivot pin having an upper stem and having a threaded lower shaft configured to threadingly engage said threaded bore of said threshold lug; and a cap member configured to be fixedly mounted onto said upper stem of said pivot pin, said cap member having a tool engaging portion and a recess formed in its lower surface for clearing said shank of said threshold lug;

whereby when said threaded shaft of said threshold lug is inserted through said hole in said threshold from one side of said threshold, said threshold lug nut is threaded onto said shaft of said threshold lug from the opposite side of said threshold to clamp said threshold lug to said threshold; and whereby when said cap member is fixedly mounted onto said upper stem of said pivot pin, said tool engaging portion of said cap member may be engaged by a tool to thread said pivot pin into said threaded bore of said threshold lug, said recess in said lower surface of said cap member clearing said shank of said threshold lug to permit said cap member to fit down over said shank.

2. The door pivot assembly of claim 1, wherein said threshold comprises walls defining a recess in an upper surface thereof adjacent said hole, and wherein said collar of said threshold lug is configured to be received within said recess in said upper surface of said threshold.

3. The door pivot assembly of claim 2, wherein said recess in said threshold and said collar of said threshold lug are configured such that when said flange is received within said threshold, said collar engages said walls defining said recess to prevent said threshold lug from turning with respect to said threshold.

4. The door pivot assembly of claim 1, wherein said cap member is fixedly mounted onto said upper stem of said pivot pin by interference engagement between said cap member and said pivot pin.

5. An apparatus for mounting a door for pivotable movement comprising:

a threshold having walls defining a recessed portion in an upper surface thereof and having a hole formed therethrough in said recessed portion;

a threshold lug having a collar formed thereon and having an externally threaded shaft extending below said collar, said collar being configured such that when said threaded shaft is inserted through said hole in said threshold said collar engages said walls defining said recessed portion in said upper surface of said threshold to prevent said threshold lug from turning within said hole; and a threshold lug nut configured to threadably engage said externally threaded shaft of said threshold lug such that when said threaded shaft is inserted through said hole in said threshold, said threshold lug nut may be threadably engaged with said threaded shaft of said threshold lug to secure said threshold lug to said threshold.

6. The apparatus of claim 5, wherein said threshold lug further comprises a threaded bore formed therethrough, said apparatus further comprising:

a pivot pin having a threaded lower shaft for threadingly engaging said threaded bore in said threshold lug, said pivot pin having an upper stem; and a cap member configured to be fixedly mounted onto said upper stem of said pivot pin, said cap member having a tool engaging portion and a recess formed in its lower surface for clearing said shank of said threshold lug.

* * * * *